US005236287A

United States Patent [19]

Dugge et al.

[11] Patent Number: 5,236,287

[45] Date of Patent: Aug. 17, 1993

[54] PNEUMATIC OUTLET

[75] Inventors: Richard H. Dugge, Des Peres; Gary J. McClain, Imperial, both of Mo.

[73] Assignee: ACF Industries, Incorporated, Earth City, Mo.

[21] Appl. No.: 940,340

[22] Filed: Sep. 3, 1992

[51] Int. Cl.[5] ..... B65G 53/40; B61D 7/02

[52] U.S. Cl. ..... 406/145; 105/247; 222/556

[58] Field of Search ..... 406/145, 128, 130, 131; 105/247, 248, 280, 283; 222/556

[56] References Cited

U.S. PATENT DOCUMENTS

| | | | |
|---|---|---|---|
| 3,350,141 | 10/1967 | McGrath . | |
| 3,482,741 | 12/1969 | Fritz | 222/554 |
| 3,554,609 | 1/1971 | Rollins | 406/145 X |
| 3,659,752 | 5/1972 | Carney, Jr. et al. | 222/195 |
| 3,701,460 | 10/1972 | Dugge et al. | 222/193 |
| 3,715,053 | 2/1973 | Carter | 406/145 |
| 3,778,114 | 12/1973 | Carney, Jr. et al. . | |
| 4,018,484 | 4/1977 | Dugge et al. . | |
| 4,114,785 | 9/1978 | Dugge | 222/545 |
| 4,312,607 | 1/1982 | Van Auken | 406/128 |
| 4,411,560 | 10/1983 | McComb | 406/145 X |
| 4,974,999 | 12/1990 | Fritz | 406/145 |
| 4,975,000 | 12/1990 | Fritz | 406/145 |

*Primary Examiner*—David M. Mitchell
*Assistant Examiner*—James M. Kannofsky
*Attorney, Agent, or Firm*—Polster, Lieder, Woodruff & Lucchesi

[57] ABSTRACT

A pneumatic outlet (10) is for use on a railcar (C) for discharging a lading from a hopper (H) of the railcar. An improvement to the outlet comprises a bottom cover (16) extending the length of the outlet. This cover is severable into two sections (44A, 44B) one of which is reversible with respect to the other. The two sections are joined together to form an integral cover through which lading flows during discharge. A bulkhead divider (48) is installed in the cover at the juncture between the two cover sections. A pair of outlet valves (12A, 12B) are installed in the cover. The valves are mounted on respective valve shafts (54A, 54B) which are installed in the cover with the inner end of each valve shaft being removably mounted on the divider. An end closure (64A, 64B) is installed at each end of the outlet, and the outer end of each valve shaft is located adjacent a respective closure. Each end closure is pivotally mounted to an end wall (90A, 90B) of the outlet. This allows a closure to be rotated away from the end wall of the outlet and permits access to the interior of the outlet for cleaning the outlet, or for removal of a valve for repair or replacement.

20 Claims, 4 Drawing Sheets

PNEUMATIC OUTLET

This invention relates to pneumatic outlets used on railway cars for discharging lading and, more particularly, to a pneumatic outlet having improved clean-out features.

Pneumatic outlets for offloading lading from railcars such as covered hopper railway cars are well known in the art. See, for example, U.S. Pat. Nos. 4,382,725; 4,114,785; 3,778,114; 3,701,460, and 3,350,141; all of which are assigned to the same assignee as the present invention. As discussed in co-pending patents application Ser. No. 917,341, filed Jul. 23, 1992, these outlets had a bottom cover extrusion which extended across the car from one side to the other, and attached to respective side sheets and end sheets to complete the outlet body. A pair of diagonally spaced outlet valves were housed in this bottom cover, with one valve covering one-half of the hopper, and the other valve the opposite half. A bulkhead sub-assembly, fitted into the bottom extrusion, was used for mounting the valve shafts. This co-pending application addresses an improved outlet and its method of manufacture by which gaps and flat spots, which previously occurred between the bottom cover extrusion and the sub-assembly, are eliminated. A particular advantage of this new outlet is that certain ladings, required to be essentially free of any contaminating material, will be.

While the construction of this improved outlet helps keep ladings from being contaminated, as a practical matter, the railcar is in continuous use. As with any piece of valuable equipment, maintenance of the outlets means they should be periodically cleaned and serviced. Because outlets will constantly have ladings discharged through them, there is also the possibility a valve will become worn or damaged and need to be replaced. Previously, access to the interior of the outlet for cleaning, or for access to a valve, required removal of an end cover assembly located at the side of the outlet. With the cover off, a worker could wash out the outlet, or the valve could be removed through the side of the outlet. Alternately, the entire outlet had to be detached from the underside of the railcar and disassembled. Either way, repair or replacement of a valve was time consuming and costly.

SUMMARY OF THE INVENTION

Among the several objects of the present invention may be noted the provision of an improved pneumatic outlet for use on railway cars such as covered hopper cars; the provision of such an outlet having diagonally spaced valves for unloading lading from both sides of the hopper; the provision of such an outlet having a divider assembly on which an inner end of each valve is installed; the provision of such a divider assembly being installed in an outlet cover with no gaps between the divider assembly and cover; the provision of such an improved outlet in which the valves are easier to install and align thereby improving valve operation; the provision of such an improved outlet in which removal of a valve for repair or replacement is having a swing-away end cover at each end of the outlet, movement of the cover providing easy access to the interior of the outlet for cleaning the outlet, or for installation and removal of a valve; and, the provision of such an improved outlet in which the swing-away cover further allows ready access to the interior of the outlet without having to remove the outlet from the railcar and disassemble it.

In accordance with the invention, generally stated, a pneumatic outlet is for use on a railcar for discharging a lading from a hopper of the railcar. An improvement to the outlet comprises a bottom cover extending the length of the outlet. This cover is severable into two sections one of which is reversible with respect to the other. The two sections are joined together to form an integral cover through which lading flows during discharge. A bulkhead divider is installed in the cover at the juncture between the two cover sections. A pair of outlet valves are installed in the cover. The valves are mounted on respective valve shafts which are installed in the cover with the inner end of each valve being removably mounted on its respective valve shaft. An end closure is installed at each end of the outlet, and the outer end of each valve is rotatably installed adjacent a respective closure. Each end closure is pivotally mounted to an end wall of the outlet. This allows a closure to be rotated away from the end wall of the outlet and permits access to the interior of the outlet for cleaning the outlet, or for removal of a valve for repair or replacement. Other objects and features will be in part apparent and in part pointed out hereinafter.

BRIEF DESCRIPTION OF THE DRAWING

Corresponding reference characters indicate corresponding parts throughout the drawings.

DESCRIPTION OF THE PREFERRED EMBODIMENT

Figure 2:
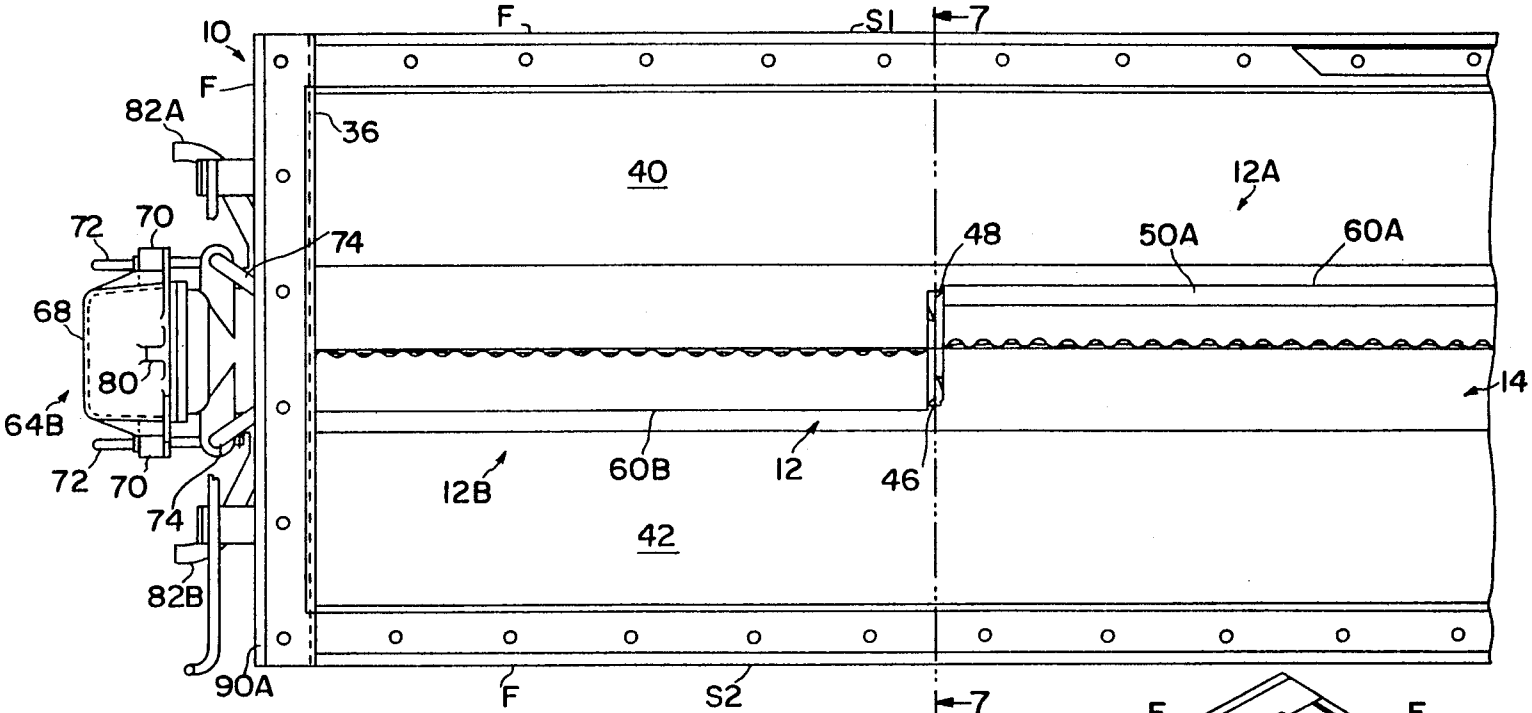
FIG. 2 is a top plan view of the outlet illustrating an end closure of the outlet assembly in its closed position.

Referring to the drawings, a covered hopper railway car C has a plurality of hoppers H in which lading L is transported. The lading may be any type of particulate or pelletized lading, such as is well known in the art. An improved outlet 10 of the present invention is installed at the bottom of each hopper for discharging lading. For this purpose, pneumatic discharge apparatus generally indicated A is attached to outlet 10 when lading is to be discharged. Each outlet has a pair of outlet valves 12A, 12B which, when opened, allow the lading to flow into a discharge tube 14 of the outlet. The lading is then entrained in an airstream and drawn off through apparatus A.

If the railcar is in constant service, there is a continuous flow of material through the hoppers and the outlets. Many ladings are extremely valuable. The presence of even a few particles of a contaminant, the prior lading, dirt, etc., may substantially reduce the value of a lading. This means the outlet should be periodically cleaned out so that any accumulated dust or dirt is removed. In addition, the flow of particles through the valves causes wear over time. To facilitate both cleaning and valve repair or replacement, the improved pneumatic outlet 10 allows ready access to the interior of the outlet, for cleaning or other maintenance. It also allows valves to be quickly replaced. Facilitating cleaning and repair reduces both and the cost of maintenance, and allows to be back in revenue service quicker than with prior art outlets.

Figure 3:
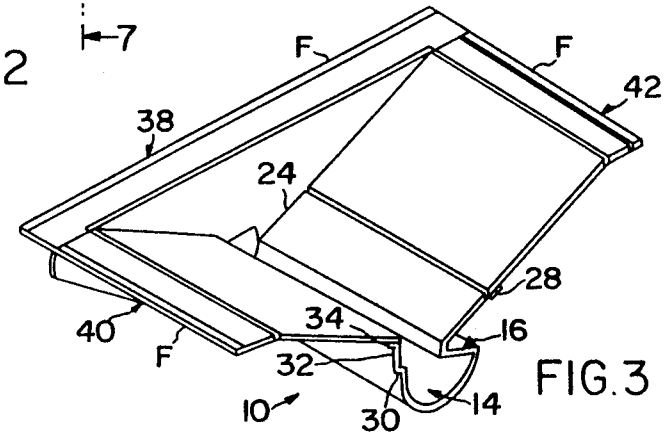
FIG. 3 is a perspective view of a bottom cover portion of the outlet.
Figure 1:
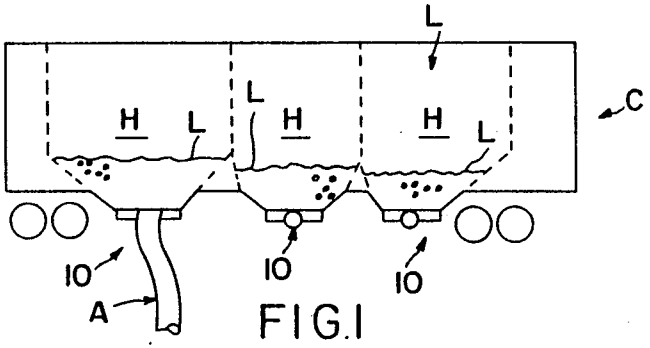
FIG. 1 illustrates an improved outlet of the present invention installed on a covered hopper railway car.
Figure 7:
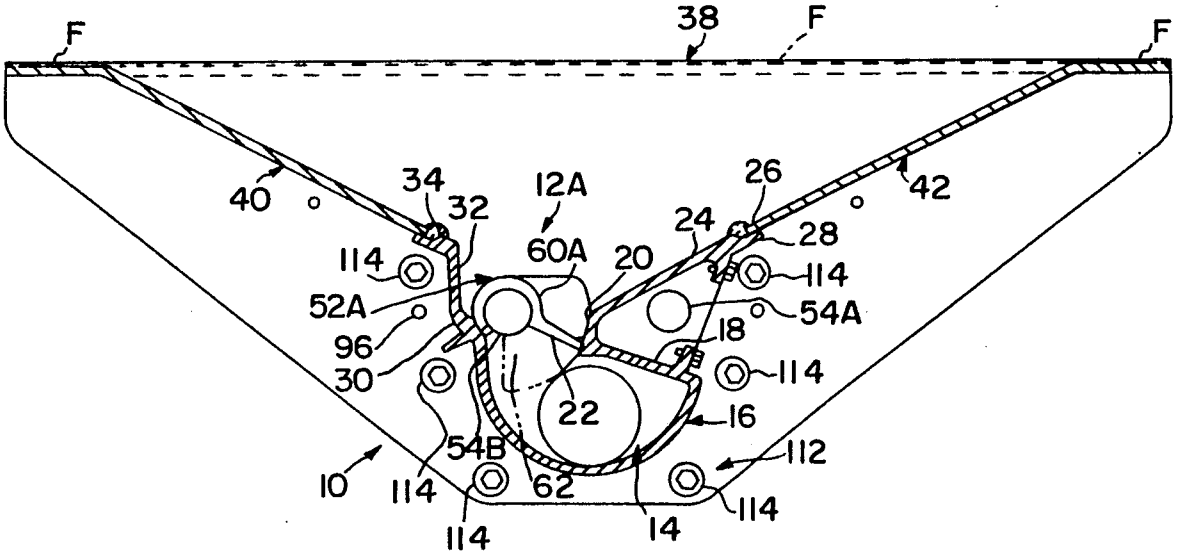
FIG. 7 is an elevational view of a bulkhead divider assembly taken along line 7—7 of FIG. 2.
Figure 8:
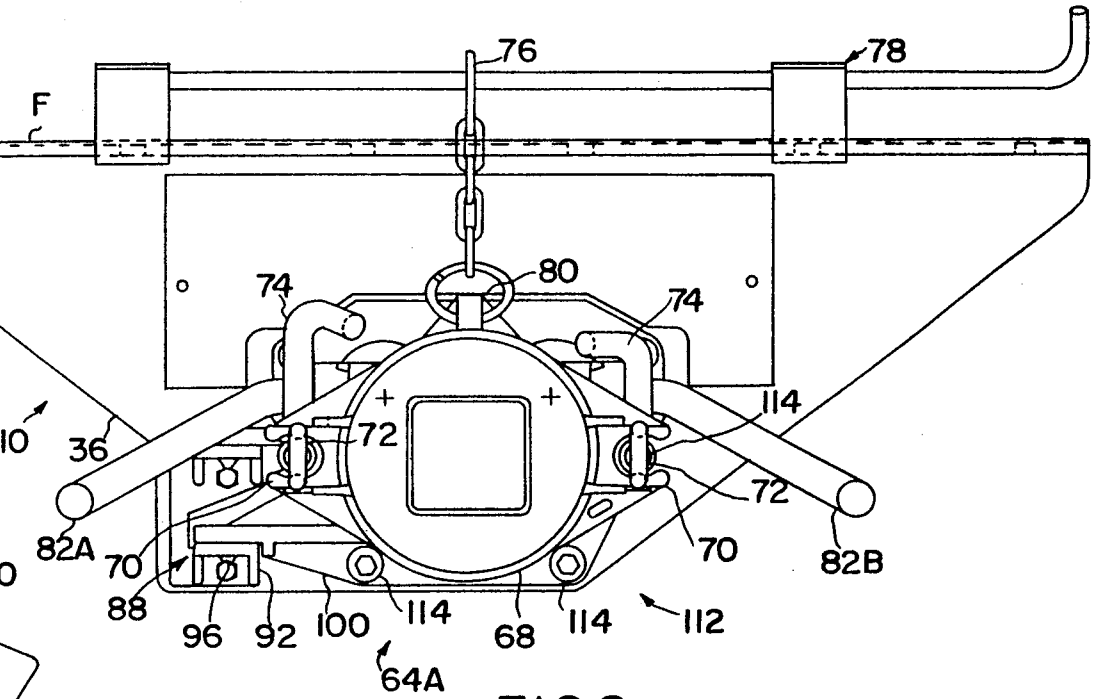
FIG. 8 is an elevational view of the outlet and an end closure pivotally mounted on the outlet; and, FIG. 9 is a side elevational view of the end closure.

An outlet for use on a railway car C has been developed in which gaps and deformities which occurred during fabrication, and which sometimes caused a contamination problem have been eliminated. This outlet is described in co-pending patent application Ser. No. 917,341, which is incorporated herein by reference. To fully understand the improvements of the present invention, certain features of outlet 10 are described herein. Outlet 10 includes a bottom cover 16 which extends the length of the outlet. As shown in FIGS. 3 and 7, bottom cover 16 is generally semi-circular in shape, and as such, forms the discharge tube 14 by which lading is drawn off. The cover has an inwardly and upwardly angled section 18 on one side as viewed in FIG. 7, and a short, vertical section 20 which extends upwardly from section 18. Section 20 has a slight concave curvature to allow a planar section 22 of valve 12 to readily move between a valve open and valve closed position. Above section 20, the cover has an outwardly and upwardly flaring section 24. A recess 26 is formed at the outer end of section 24 and extends the length of the cover. The upper end of the bottom cover, on its other side of the bottom cover, flattens into a generally vertically extending section 28. This section 28 extends somewhat above the lower end of cover section 18. A concavely curved section 30 extends outwardly from the upper end of section 28, and another vertical section 32 extends upwardly from section 30. Section 32 flares outwardly at its upper end, and a recess 34, similar to recess 26, extends the length of the bottom cover.

Referring to FIG. 3, cover 16 attaches to respective end sheets 36 and 38, and to side sheets 40 and 42. The end sheets and side sheets form respective end walls and side walls of outlet 10 when they are attached to the bottom cover. The lower end of the side sheets fit with the recesses 26 and 34 at the upper ends of cover 16 to provide a smooth surface between the side sheets and bottom cover. Each end sheet is a vertically extending sheet metal piece having a flange F formed at its upper end. Each side sheet is a sloping sheet of metal which also has a flange F at its upper end. The flanges have spaced openings for mounting outlet 10 to the bottom of a hopper H.

As is described in co-pending application Ser. No. 917,341, cover 16 is cut in half to form two sections. One of these sections is reversed and the two sections are then welded together. A recess 46 is formed between the abutting ends of the sections and a spacer 48 is fitted into this recess. Spacer 48 forms a bulkhead or divider between the two sections. The size and shape of the spacer is such that then the abutting ends of the bottom cover sections are joined to the spacer, no gaps or deformities are created.

Figure 5:
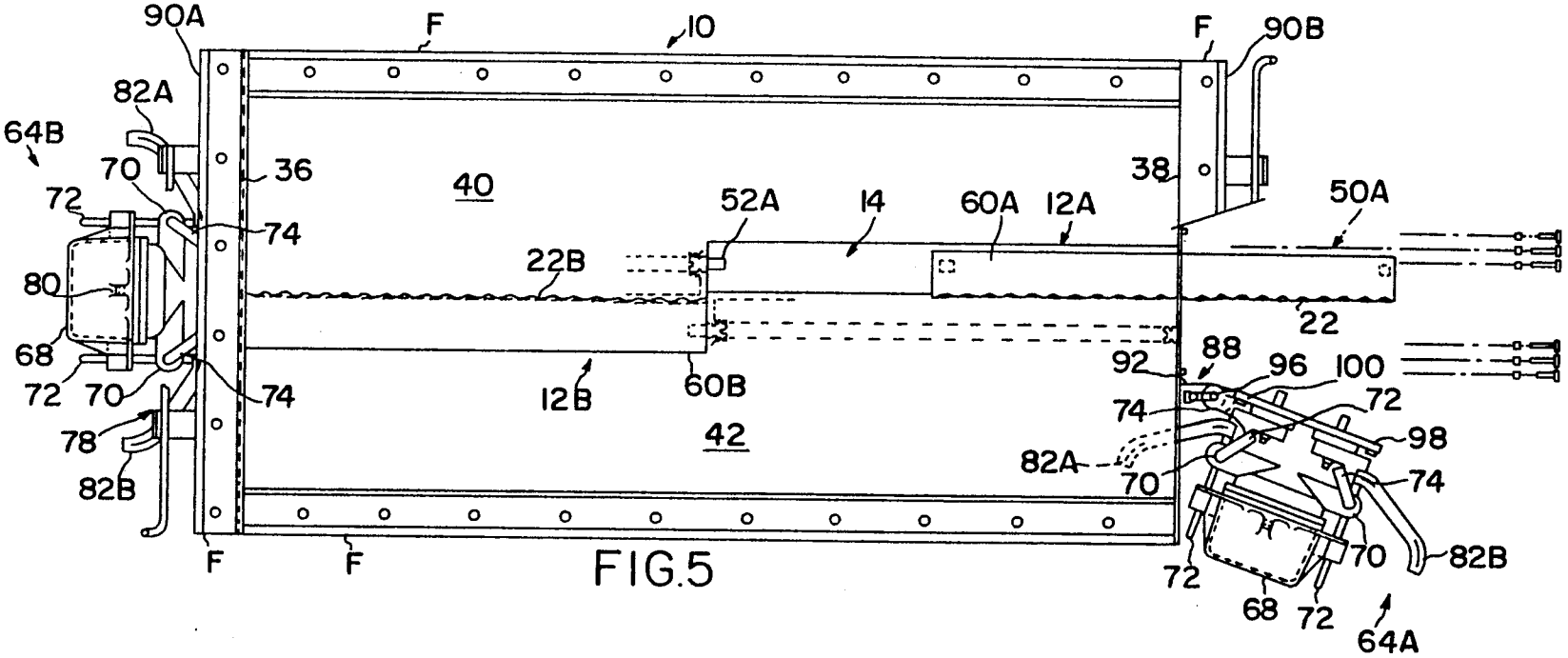
FIG. 5 is a top plan view of the outlet illustrating an end closure of the outlet assembly in its pivoted open position which allows removal of an outlet valve and access to the outlet for cleaning.
Figure 6:
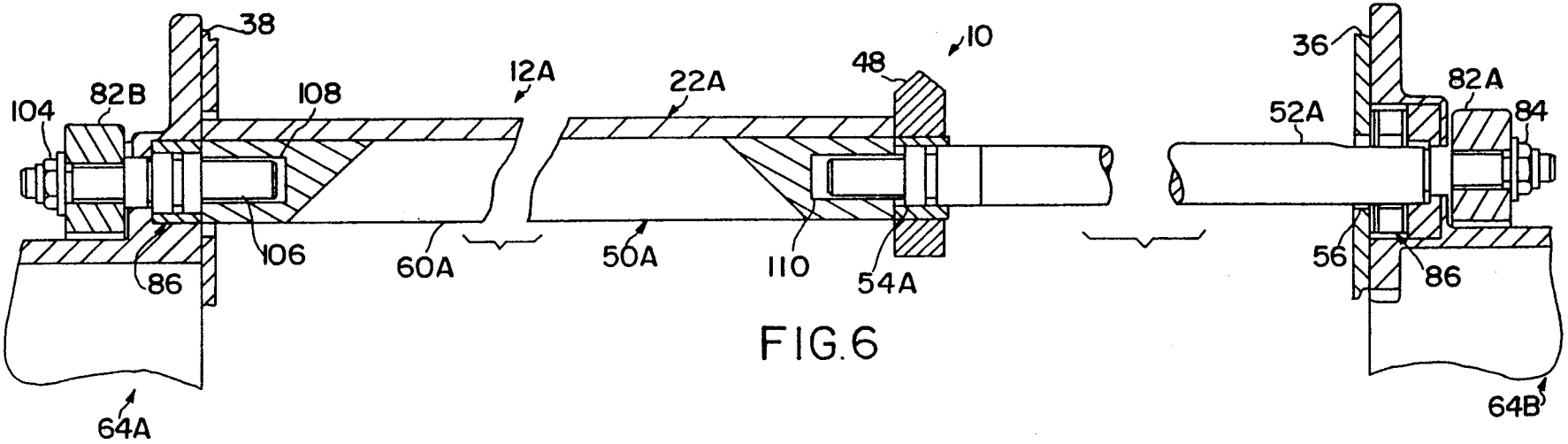
FIG. 6 illustrates installation of a valve in the outlet.

Outlet valves 12A and 12B are installed in cover 16. The valves are identical in construction, each valve including a valve member (50A) mounted on a valve shaft (52A, 52B). The inner end of the respective shafts are installed in spaced openings 54A, 54B in spacer 48. The outer end of valve shaft 52A is received in an opening 56 in end sheet 36, and the outer end of shaft 52B is received in an opening in end sheet 38. Each valve member has an arcuate section (60A, 60B), for fitting the valve member on its respective shaft, and a generally planar section (12A, 12B) whose outer end is upturned as indicated at 62. As shown in FIGS. 2 and 5, valve members 50A, 50B are installed in cover 16 in a diagonal arrangement. Each valve, when opened, therefore allows lading to discharge from one side of the hopper.

Figure 4:
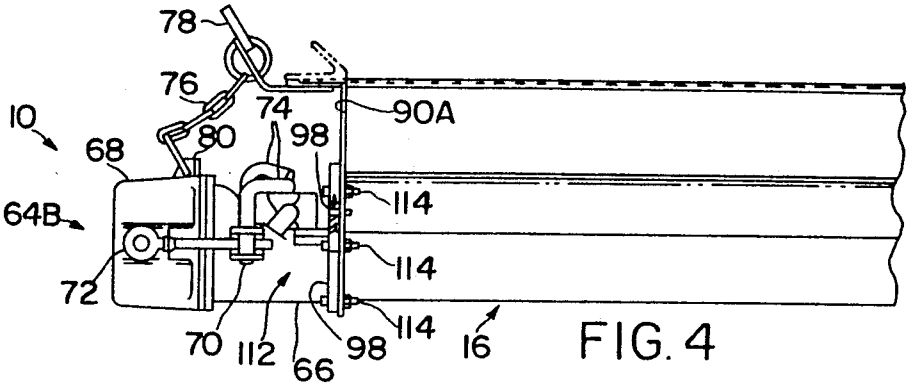
FIG. 4 is a side elevational view of the outlet.
Figure 9:
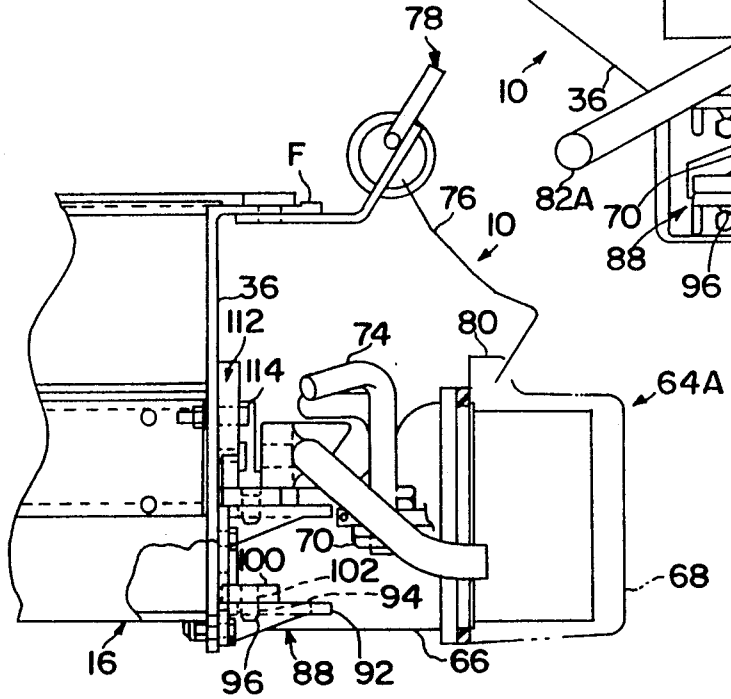

End closures 64A, 64B, are attached to respective end sheets 38, 36. The closures are used to adapt discharge apparatus A to outlet 10 so lading can be discharged. As shown in FIGS. 4 and 9, each end adaptor has a horizontally extending discharge tube 66 whose open end is closed by a removable cap 68. Cap 68 includes notched ears 70 for receiving rotatable locking rods 72. The rods are turned by vertically extending handles 74. When cap 68 is removed, a chain 76 (which attaches at one end to a bracket assembly 78 on the adaptor, and an ear 80 on the cap) keeps the cap from being misplaced. With the cap removed, a discharge hose can be connected to tube 66.

Valve control handles 82A, 82B are located on both adaptors. These permit the unloading operator to open and close either or both valves 50A, 50B, from either side of the railcar. They also allow him to control the degree of valve opening. The outer end of both valve shafts are threaded and a nut 84 secures the valve handles to the respective valve. A bushing assembly 86 installed on each valve shaft, where the shaft enters the respective end closure provides a smooth rotational motion of the valve when the valve handle is turned.

Referring to FIG. 5, it is shown that the end closures are pivotally attached to the respective end sheets of the outlet. Brackets 88 are welded or otherwise secured to the outer face 90A, 90B of the end sheets. Each bracket has a horizontal mounting plate 92 with an opening 94 for a vertically extending mounting bolt 96. End closures 64 have an end plate 98 which abuts the outer face of the respective end sheet. A horizontally extending bracket 100 is affixed to plate 98 and this bracket has an opening 102 sized to accommodate the mounting bolt. During assembly of the outlet, each end closure 64 is installed on its associated bracket 88 using bolt 96. This allows the end closures to swivel or swing-away from the side of the outlet exposing the interior of the outlet.

With an end closure moved to its outlet opening position shown in FIG. 5, a worker has ready access to the outlet to clean it. It also allows the worker to inspect the interior to determine if the valve or other parts of the outlet have been damaged during transport and off-loading of a lading. If a valve needs to be removed for repair or replacement, or for a more thorough inspection, or to better clean the interior of the outlet, the worker loosens a nut 104 on the threaded outer end of a stub shaft 106 which fits into a recess 108 of a valve member. After the nut is removed, the valve handle 82 is removed and shaft 106 can be withdrawn. This frees up valve member so it can be removed. To reinstall the valve member, it is inserted in the outlet until a recess 110 at the inner end of valve member is slipped onto the inner end of the valve shaft 52. Then, stub shaft 106 is inserted into recess 108, the valve handle is fitted onto the stub shaft, and nut 104 is tightened back into place.

To further simplify the above described cleaning or replacement operations, each end closure 64 is equipped with quick disconnect means 112. Means 112 comprises at least two quick disconnect fasteners 114 by which the end closure is attached to its respective end sheet of the outlet. The two fasteners respectively attach the end closure to the end sheet on opposite sides of the discharge tube. It will be understood that up to six fasteners (three on each side of the discharge tube at the top, middle, and bottom of the end closure) may be used. The fasteners are sufficiently strong that the end closure is not inadvertently released from the side of the outlet during movement of the railcar. This would allow the end closure to pivot away from the side of the outlet and expose the interior of the outlet to dirt, dust, etc., potentially ruining the lading. At the same time, the fasteners allow a worker to quickly release the end closure for the cleaning or valve replacement steps discussed above.

What has been described is an improved pneumatic outlet for use on railway cars such as covered hopper cars. The outlet has diagonally spaced valves for unloading lading from both sides of a hopper, and a divider assembly on which an inner end of each valve is installed. The divider assembly is installed with no gaps between the divider assembly and outlet cover. The outlet is manufactured such that the valves are easier to install and align. This helps improve valve operation and makes removal of a valve for repair or replacement more readily accomplished. The outlet has a swing-away end cover at each end of the outlet. Movement of these covers provides easy access to the interior of the outlet for installation and removal of a valve. It also provides ready access to the interior of the outlet for cleaning it. This reduces the possibility of lading contamination.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

Having thus described the invention, what is claimed and desired to be secured by Letters Patent is:

1. In a pneumatic outlet for use on a railcar for discharging a lading from a hopper of the railcar, the improvement comprising:

a bottom cover extending the length of the outlet and in two identical sections one of which is reversed with respect to the other, the two sections being joined together at a juncture to form an integral cover through which lading flows during discharge;

a bulkhead divider installed in the cover at the juncture of the two cover sections;

a pair of outlet valves installed in the cover, said valves being mounted on respective valve shafts which are installed in the cover with an inner end of each valve being removably mounted on its valve shaft; and, respective end closures installed at respective ends of the outlet with an outer end of each valve being mounted to a respective said end closure, each said end closure being pivotally mounted to a respective end wall of the outlet by a means for rotating the closure away form the end wall of the outlet for allowing access to the interior of the outlet for cleaning the outlet and for removal one of said valves for repair and replacement.

2. The improved outlet of claim 1 wherein the outlet valves are installed in the cover in a diagonal arrangement whereby each valve allows discharge of lading from a respective side of the hopper.

3. The improved outlet of claim 2 including a pair of side sheets and pair of end sheets to which respective sides and ends of the bottom cover are attached, the side sheets and said end sheets respectively defining side walls and end walls of the outlet, and each of said means for rotating comprising a bracket on a respective one of said end sheets and to which a respective said end closure is pivotally attached.

4. The improved outlet of claim 3 wherein the outer ends of said valves are rotatably attached to the respective end closures.

5. The improved outlet of claim 3 wherein each end closure is hingedly connected to its associated bracket, and the outlet further includes connection means for connecting the respective end closure to the respective end sheet in an outlet closing position.

6. The improved outlet of claim 5 wherein the connection means includes at least two quick disconnectors located on opposite sides of the end closure for connecting the end closure to the end sheet.

7. The improved outlet of claim 6 wherein the respective valve shafts are parallel to each other, one end of each valve shaft being rotatably connected to a respective said end sheet, and each valve shaft extending through respective openings in the divider for the other ends of the valve shafts on which the inner end of their respective valves are mounted to be on opposite sides of the divider from a side of a portion of the outlet through which their associated valve shafts extend.

8. The improved outlet of claim 7 wherein each end sheet has an opening in which the outer end of one of said valves is received, and he outlet further includes fastening means for connecting said one of said valves to the end closure mounted on that end sheet.

9. The improved outlet of claim 8 wherein the fastening mans includes a pair of pins, the inner end of each of which is receivable in the outer end of each respective valve, each said pin extending through a respective said opening in a respective said end closure whereby the valves are pivotably installed in the outlet.

10. The improved outlet of claim 9 wherein the outer end of each pin is threaded nd the fastening means includes means threadably received on said outer end of said pin, said fastening means being removed from a said pin prior to disconnecting the connecting means and hingedly opening a one of said end closures whereby the associated valve is removably from the outlet.

11. In an outlet for discharging a lading form a hopper, the outlet being defined by a cover extending the length of the outlet and by a pair of side sheets and a pair of end sheets receptively defining side walls and end walls of the outlet, the cover being attached to said side sheets and said end sheets, and a bulkhead divider installed in the cover for dividing the cover into two sections and for separately discharging the lading dischargeable through each section, the improvement comprising:

outlet valves installed one in each section of the outlet, said valves being mounted on respective valve shafts which are installed in the outlet with an inner end of each valve being removably mounted on its valve shaft; and, respective end closures installed at respective ends of the outlet with an outer end of each valve being mounted to a respective said end closure, each said end closure being pivotally mounted to a respective said end sheet of the outlet by means for rotating the closure away from the end wall of the outlet for allowing access to the interior of the outlet for cleaning the outlet and for removal of one of said valves for repair and replacement.

12. The improved outlet of claim 11 wherein each end sheet has a bracket thereon to which a respective one of said end closures is pivotally attached.

13. The improved outlet of claim 12 wherein the respective valve shafts are parallel to each other, one end of each valve shaft being rotatably connected to a respective said end sheet, and each valves that extending through respective openings in the divider for the other ends of the valve shafts on which the inner ends of their respective valves are mounted to be on opposite sides of the divider from a side of the outlet through which their associated valve shafts extend.

14. The improved outlet of claim 13 wherein said means for rotating each end closure comprises a hinged connection of each end closure to an associated bracket and the outlet further includes connection means for connecting each of the end closures to its respective end sheet in an outlet closing position.

15. The improved outlet of claim 14 wherein the connection means includes a plurality of quick disconnectors installed on each end closure for connecting each end closure to its respective end sheet.

16. The improved outlet of claim 13 wherein each end sheet has an opening in which the outer end of a respective one of said valves is received, and the outlet further includes fastening means for connecting said one of said valves to the end closure mounted on that end sheet.

17. The improved outlet of claim 16 wherein the fastening means includes a pin for each valve, an inner end of each pin being receivable in the outer end of each respective vale, a respective each pin extending through an opening in each respective said end closure associated with a respective said valve whereby the valves are pivotally installed in the outlet.

18. The improved outlet of claim 17 wherein the outer end of each pin is threaded and the fastening means further includes a nut threadably received on said outer end f said pin, said nut being removed form said pin prior to disconnecting a one of the end closures from its associated end sheet and moving the end closure to its outlet opening position whereby he associated valve is removable from the outlet.

19. A pneumatic outlet or discharging lading form a railcar hopper comprising:

a bottom cover extending the length of the outlet;

a pair of side sheets and a pair of end sheets to which respective sides and ends of the bottom cover are attached, the side sheets and end sheets respectively defining side walls and end walls of the outlet;

a bulkhead divider installed in the cover for dividing he outlet into two sections through each of which lading is dischargeable;

outlet valves installed are in each outlet section, said valves being mounted on respective valve shafts which are installed in the over with an inner end of each valve being removably mounted on its valve shaft, the valve shafts being installed in the outlet in a side-by-side relationship with one end of each valve shaft being rotatably connected to a respective said end sheet, and each valve shaft extending through respective openings in the divider for the other ends of the valve shafts on which the inner ends of their respective valves are mounted to be on opposite sides of the divider from a side of the outlet through which their associated valve shafts extend; and, respective ned closures installed at respective ends of the outlet with an outer end of each said valve being mounted to a respective said end closure, each said end closure being pivotally mounted to a respective said end wall of the outlet by means for rotating the closure away from the end wall of the outlet for allowing access to the interior of the outlet for cleaning the outlet and for removal of one of said vales for repair and replacement, said means for rotating comprising a bracket on each end sheet and to which a respective said end closure is pivotally attached, and connection means for connecting the respective end closure to the respective end sheet in an outlet closing position, the connection means being disengageable to allow the respective end closure to be pivotably moved to an outlet open position.

20. The outlet of claim 19 further including fastening means for connecting a respective said valve to a respective said end closure mounted on that end sheet, the fastening means including a pin for each valve an inner end of which is receivable in the outer end of each respective valve, and each pin extending through a respective opening in the respective end closure associated with the respective valve for the valves to be pivotally installed in the outlet, and an outer end of each pin being threaded, the fastening means further including respective nuts threadably received on said outer ends of respective said pins, said nuts being removed form said pins prior to disconnecting each of said end closures from their associated end sheets and moving the end closures to their outlet opening positions whereby the associated valves are removable from the outlet.

* * * * *

UNITED STATES PATENT AND TRADEMARK OFFICE

CERTIFICATE OF CORRECTION

PATENT NO. : 5,236,287

DATED : August 17, 1993

INVENTOR(S) : Richard H. Dugge; Gary J. McClain

It is certified that error appears in the above-indentified patent and that said Letters Patent is hereby corrected as shown below:

Column 6, line 38, delete "he" and insert --the--;
Column 6, line 54, delete "form" and insert --from--;
Column 7, line 16, delete "valves that" and insert --valve shaft--;
Column 7, line 42, delete "vale" and insert --valve--;
Column 7, line 50, delete "f" and insert --of--;
Column 7, line 50, delete "form" and insert --from--;
Column 7, line 52, delete "he" and insert --the--;
Column 7, line 55, delete "form" and insert --from--;
Column 8, line 7, delete "he" and insert --the--;
Column 8, line 11, delete "over" and insert --cover--;
Column 8, line 23, delete "ned" and insert --end--;
Column 8, line 52, delete "form" and insert --from--.

Signed and Sealed this

Thirtieth Day of August, 1994

Bruce Lehman

*Attest:*

BRUCE LEHMAN

*Attesting Officer*

*Commissioner of Patents and Trademarks*